US005679044A

United States Patent [19]

Meyer et al.

[11] Patent Number: 5,679,044

[45] Date of Patent: Oct. 21, 1997

[54] PROCESS FOR THE PRODUCTION OF A MICROTIP ELECTRON SOURCE

[75] Inventors: Robert Meyer, St Nazaire-les Eymes; Michel Borel, St. Vincent de Mercuze; Marie-Dominique Bruni, La Tronche, all of France

[73] Assignee: Commissariat a L'Energie Atomique, Paris, France

[21] Appl. No.: 535,465

[22] Filed: Sep. 28, 1995

[30] Foreign Application Priority Data

Oct. 19, 1994 [FR] France ..... 94 12467

[51] Int. Cl.[6] ..... H01J 9/02

[52] U.S. Cl. ..... 445/24

[58] Field of Search ..... 445/24, 50

[56] References Cited

U.S. PATENT DOCUMENTS 4,964,946 10/1990 Gray et al. .

5,458,520 10/1995 De Mercurio et al. ..... 445/24

FOREIGN PATENT DOCUMENTS 0 234 989 9/1987 European Pat. Off. .

0 364 964 4/1990 European Pat. Off. .

33 40 777 5/1985 Germany .

*Primary Examiner*—Kenneth J. Ramsey

*Attorney, Agent, or Firm*—Oblon, Spivak, McClelland, Maier & Neustadt, P.C.

[57] ABSTRACT

According to this process a structure is produced comprising an insulating substrate (32), at least one cathode conductor (34), an insulating layer (36), a grid layer (40) and holes (42) are formed through the grid layer and the insulating layer, on the grid layer using a wet chemical deposition method is produced a lift-off layer (44), followed by the deposition on the assembly of an electron emitting material layer (52) and the elimination of the lift-off layer. Application to the manufacture of flat screens.

8 Claims, 2 Drawing Sheets

PROCESS FOR THE PRODUCTION OF A MICROTIP ELECTRON SOURCE

TECHNICAL FIELD

The present invention relates to a process for the production of a microtip electron source.

The invention is applicable to any field where it is necessary to use such a microtip electron source and in particular flat display means also known as flat screens.

The invention e.g. makes it possible to manufacture large microtip flat screens, whose surface area can be approximately 1000 $cm^2$ and can even extend up to approximately 1 $m^2$.

PRIOR ART

Microtip emissive cathode electron sources and their production processes are e.g. described in the following documents, to which reference should be made:

(1) FR-A-2 593 953 corresponding to EP-A-234 989 and U.S. Pat. No. 4,857,161, (2) FR-A-2 623 013 corresponding to EP-A-316 214 and U.S. Pat. No. 4,940,916, (3) FR-A-2 663 462 corresponding to EP-A-461 990 and U.S. Pat. No. 5,194,780, (4) FR-A-2 687 839 corresponding to EP-A-558 393 and U.S. application Ser. No. 08/22,935 of 26.2.1993 (Leroux et al.).

In particular, document (1) describes a matrix structure microtip electron source and a process for the production of said source. Documents (2) to (4) relate to improvements to the source described in document (1).

In all the cases considered in these documents, the microtips are produced by a vacuum deposition method, which is in two stages. These stages are described hereinafter with reference to the attached FIG. 1.

A first stage consists of depositing or evaporating under a grazing incidence a lift-off layer, e.g. made from nickel.

More specifically, FIG. 1 diagrammatically and partially shows a structure comprising an electrically insulating substrate 2, e.g. of glass, cathode conductors 4 on said substrate, and electrically insulating layer 6 covering each cathode conductor and an electrically conductive grid layer 8 covering said electrically insulating layer.

After producing this structure, holes 10 are formed through the grid layer 8 and the electrically insulating layer 6, level with each cathode conductor 4.

FIG. 1 shows the lift-off layer 12 formed on the grid layer 8. The deposition of the layer 12 under grazing incidence makes it possible to selectively deposit nickel on the grid layer 8 without it reaching the bottom of the holes.

A second stage consists of depositing on the complete structure obtained in this way a layer 14 of an electron emitting material such as e.g. molybdenum. This deposition takes place by evaporating the molybdenum under a virtually normal incidence.

Under these conditions, a molybdenum microtip 16 is formed in each hole and rests on the cathode conductor corresponding to said hole.

Finally, the lift-off layer 12 is eliminated and this leads to the elimination of the molybdenum layer 14.

The major disadvantage of the procedure described hereinbefore is the evaporation of the lift-off layer under grazing incidence. Such a stage makes the evaporation equipment much more complicated and limits its capacity.

In particular, the grazing incidence makes it possible to place on a ring in the evaporation device the structures on which it is wished to form the nickel layer, which limits the filling level of said device.

Moreover, a tilting system is necessary in order to move from a grazing incidence to a virtually normal incidence.

Processing takes a long time, more particularly due to the evaporation of the nickel, which must take place at a low speed in order to prevent splashing.

The evaporation of the material leading to the microtips takes place under an incidence angle below 10% (virtually normal incidence).

Therefore, it is only possible to treat in said evaporation device substrates whose size (diagonal in the case of rectangular substrates) does not exceed 14 inches (approximately 35 cm).

Therefore it is difficult to use an evaporation distance exceeding 1 m in said device. Beyond this distance of 1 m, it is not easy to obtain an adequate evaporation rate and the pollution risks of the evaporated layers are increased.

DESCRIPTION OF THE INVENTION

The object of the invention is to obviate the aforementioned disadvantages, by replacing evaporation under a grazing incidence by a wet chemical deposition.

More specifically, the present invention relates to a process for the production of a microtip electron source, in which:

- a structure is produced having an electrically insulating substrate, at least one cathode conductor is located on said substrate, an electrically insulating layer covers each cathode conductor, an electrically conductive grid layer covering said electrically insulating layer,
- holes are formed through the grid layer and the electrically insulating layer level with each cathode conductor,
- on the grid layer is formed a lift-off layer,
- on the complete structure obtained in this way is deposited an electron emitting material layer leading to the formation in each hole of a microtip, and
- the lift-off layer is eliminated and this leads to the elimination of the electron emitting material layer placed above the lift-off layer, characterized in that the lift-off layer is formed by a wet chemical deposition method.

The invention more particularly makes it possible to simplify the evaporation device referred to hereinbefore and increase the production capacity thereof, as will be shown hereinafter. The invention also makes it possible to deposit microtips on large surfaces.

The following methods can be used as wet chemical deposition methods: electrolytic deposition or chemical deposition in solution.

However, according to a preferred embodiment of the process according to the invention, the wet chemical deposition is an electrolytic deposition. In this case, the grid layer is used as the cathode for said electrolytic deposition. Preferably, the lift-off layer is eliminated by electrolysis. This lift-off layer can be made from a material chosen from within the group including Cr, Fe, Ni, Co, Cd, Cu, Au, Ag and alloys of said metals.

According to a preferred embodiment of the invention, the lift-off layer is made from an alloy of iron and nickel.

The elimination of such an iron-nickel layer, following the deposition of the electron emitting material layer, is particularly easy.

BRIEF DESCRIPTION OF THE DRAWINGS

The invention is described in greater detail hereinafter relative to non-limitative embodiments and with reference to the attached drawings, wherein show.

DETAILED DESCRIPTION OF EMBODIMENTS

Figure 1:
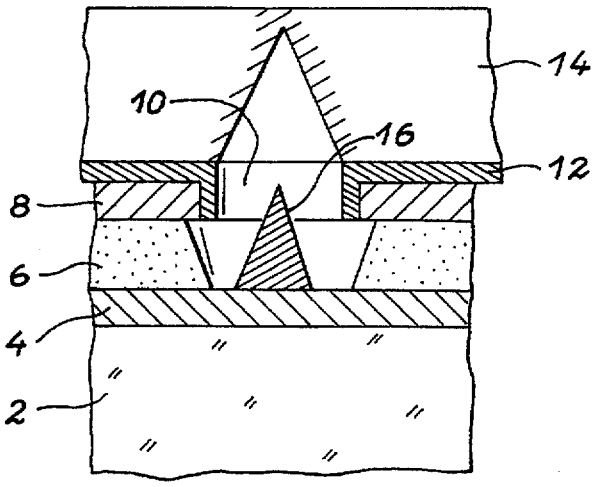
FIG. 1, already described, diagrammatically stages of the production of a microtip electron source according to the prior art.
Figure 2:
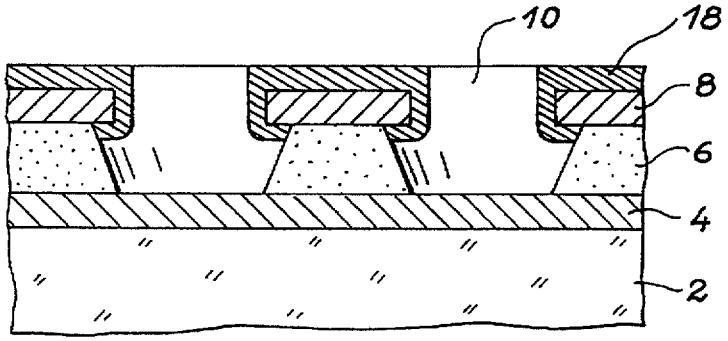
FIG. 2 Diagrammatically a stage of the production of such a source using a process according to the invention.

FIG. 2 diagrammatically illustrates a structure referred to in the description of FIG. 1 and having on the surface the grid layer 8, said structure not having the layers 12 and 14.

The structure of FIG. 2 has been coated with a lift-off layer 18 according to the invention by electrolytic deposition.

As can be seen in FIG. 2, the procedure used in the present invention leads to a selective deposition on the grid layer 8, as was made possible by evaporation under grazing incidence. It is merely necessary to polarize the grid layer 8 for it to constitute a cathode during electrolysis.

This procedure of deposition by electrolysis usable in the present invention has the advantage of being fast and inexpensive, because it does not require electrolysis equipment.

Figure 3:
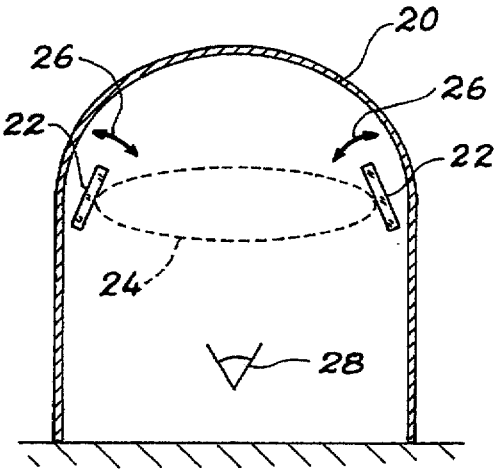
FIG. 3 A diagrammatic and partial view of an evaporating device permitting an evaporation under grazing incidence of a lift-off layer according to the prior art.

FIG. 3 shows a vacuum deposition device permitting, according to the prior art, the deposition of a lift-off layer under grazing incidence and the deposition of an electron emitting material layer under virtually normal incidence.

FIG. 3 very diagrammatically shows a vacuum enclosure 20 and in the latter substrates 22 on which firstly evaporation takes place of the lift-off layer under grazing incidence and then the deposition of the electron emitting material layer under virtually normal incidence.

It is possible to see in dotted line form a ring 24 on which is positioned the substrates 22 for the deposition under grazing incidence. Tilting means 26, which are illustrated by the arrows in FIG. 3, are provided in order to pass from deposition under grazing incidence to deposition under virtually normal incidence as from an electron emitting material source 28.

Figure 4:
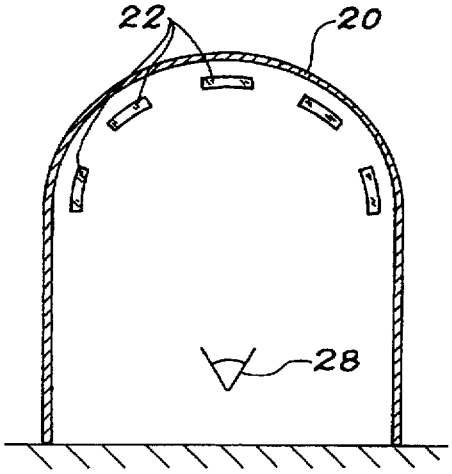
FIG. 4 A diagrammatic and partial view of an evaporating device usable for performing the present invention.

FIG. 4 shows an evaporating device usable in the present invention. This device is much simpler than that of FIG. 3 because, in a process according to the invention, all that remains is the evaporation of an electron emitting material under a virtually normal incidence in order to form the microtips.

FIG. 4 shows the enclosure 20 housing the substrates 22 and the electron emitting material source 28.

The production capacity of said device is improved compared with that of FIG. 3 as a result of a shorter treatment time and the possibility of placing more substrates in the enclosure 20 than in FIG. 3. Thus, in the device of FIG. 4, it is no longer necessary to arrange the substrates on a ring.

Moreover, due to the electrolysis-based deposition method usable in the invention, the lift-off layer can easily be deposited over large surfaces.

A process according to the invention making it possible to obtain a microtip electron source like that described in document (3) will be described hereinafter.

Figure 5:
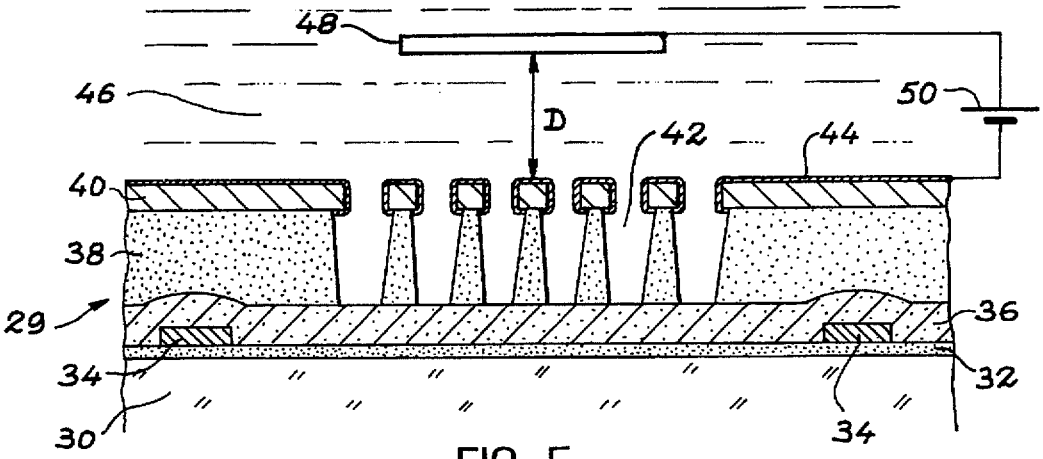
FIGS. 5 Diagrammatically stages of an embodiment of the process according and 6 to the invention.

FIG. 5 shows a structure 29 comprising a glass substrate 30 on which is formed a silica layer 32. Niobium cathode conductors 34 are formed on the silica layer 32. These cathode conductors 34 have a thickness of 0.2 μm and a lattice structure with e.g. square meshes having a spacing of 25 μm. These niobium cathode conductors 34 constitute the columns of the electron source to be formed.

A phosphorus-doped, amorphous silicon resistive layer 36 is deposited on the cathode conductors. The layer 36 is approximately 1 μm thick.

A silica insulating layer 38 is deposited on the resistive layer 36. The silica layer 38 is approximately 1 μm thick.

A niobium metallic layer 40 is deposited on the silica layer 38 and constitutes a grid layer. The grid layer 40 is approximately 0.4 μm. thick.

Diameter 1.4 μm holes 42 are etched in the grid layer 40 and in the insulating layer 38. These holes 42 are placed in the central zone of the meshes of the lattice and issue over the resistive layer 36.

According to the invention, a lift-off iron-nickel alloy layer 44 is deposited by electrolysis on the grid layer 40.

In order to do this, the structure 29 is placed in an appropriate electrolytic bath 46 and an electrode 48 constituting the anode during said electrolysis is also placed in the electrolytic bath. During said electrolysis the grid layer 40 serves as the cathode.

An appropriate voltage is applied by means of a voltage source 50 between the grid layer 40 and the electrode 48.

In an purely indicative and in no way limitative manner, the deposition conditions are as follows:

1) The composition of the electrolytic bath is:

$NiCl_2$, $6H_2O$:50 $g.1^{-1}$ $NiSO_4$, $6H_2O$:21.4 $g.1^{-1}$ $FeSO_4$:2 $g.1^{-1}$ $H_3BO_3$:25 g.1–1

Na saccharinate:0.8 $g.1^{-1}$ saccharin:0.8 $g.1^{-1}$

2) The pH of the electrolytic bath is maintained at 2.5 with, optionally, the addition of sodium tetraborate.

3) The electrode 48 serving as the anode (and which can also be called a counterelectrode) is made from nickel or an iron-nickel alloy.

4) The distance D between the electrode 48 and the grid layer 40 is 3 cm.

5) Fe—Ni deposition takes place at ambient temperature with a current density close to 2 $mA/cm^2$.

This gives in approximately 8 minutes a 200 nm thick Fe—Ni layer.

On the lift-off layer 44 is then deposited (FIG. 6) a molybdenum layer 52 with a thickness of approximately 2 μm. This deposition takes place by evaporation under a virtually normal incidence. Thus, the microtips 54 are formed in the holes 42 and rest on the resistive layer 36.

After obtaining the microtips 54, the lift-off layer 44 is dissolved by electrolysis. To do this, the structure 53 obtained after the deposition of the molybdenum layer 54 is placed in an appropriate electrolytic bath 56.

By means of an appropriate voltage source 58 a voltage is produced between the lift-off layer 44 and an appropriate electrode 60 placed in the electrolytic bath 52.

The lift-off layer 44 serves as the anode and the electrode 60 as the cathode during electrolysis.

In a purely indicative and in no way limitative manner, the conditions for removing the lift-off layer 44 and the molybdenum layer 52 are as follows:

1) The electrode 60 (which can also be called the counterelectrode) is of nickel.

2) The distance D1 between the electrode 60 and the lift-off layer 44 is approximately 3 cm.

3) The electrolyte is constituted by hydrochloric acid diluted to 10% in water.

4) Anode dissolving takes place whilst keeping the lift-off layer 44 at a voltage of +110 mV with respect to a calomel reference electrode 62 using an appropriate voltage source 64.

The voltage applied by the source 58 between the layer 44 and the electrode 60 is approximately 2 V.

During the dissolving of the layer 44, the current flowing in the latter and in the electrode 60 progressively decreases. Dissolving is ended when said current becomes zero.

Figure 6:
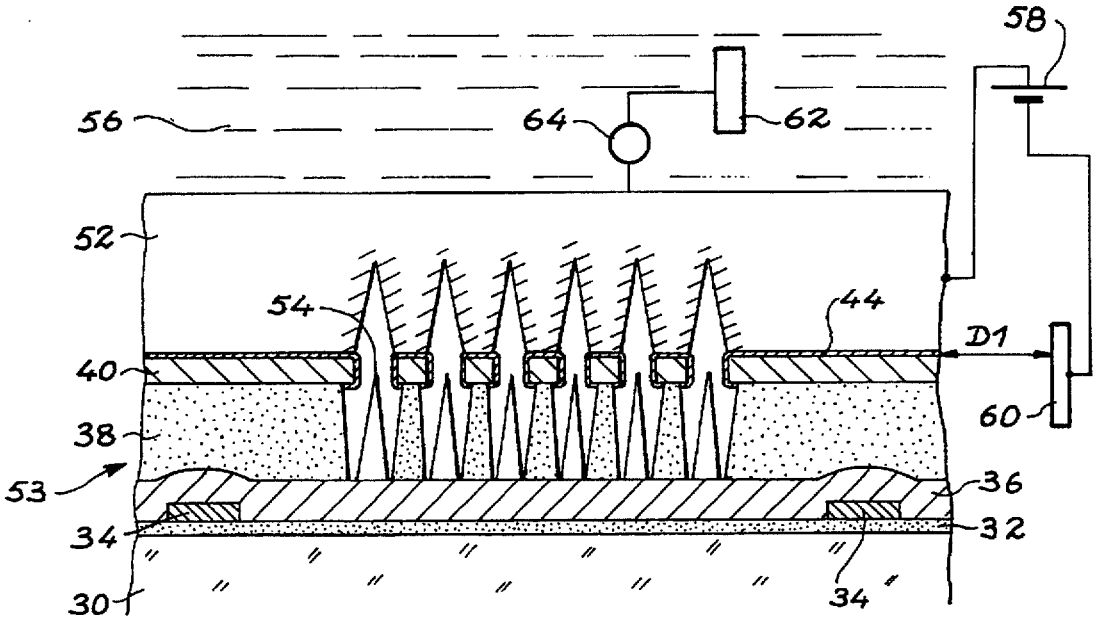

The means for measuring this current are not shown in FIG. 6.

The time necessary for dissolving the lift-off layer 44 generally varies between 30 and 60 mn.

In order to complete the manufacture of the microtip electron source of FIGS. 5 and 6, the grids are formed perpendicular to the cathode conductors by etching the grid layer.

We claim:

1. A process for producing a microtip electron source, comprising:

providing a structure comprising, (i) an electrically insulating substrate, (ii) at least one cathode conductor on said substrate, (iii) an electrically insulating layer which covers each cathode conductor, and (iv) an electrically conductive grid layer covering said electrically insulating layer;

forming holes through the grid layer and the electrically insulating layer level with each cathode conductor;

forming a lift-off layer on the grid layer;

depositing on the structure an electron emitting material layer, thereby forming a microtip in each hole; and eliminating the lift-off layer to eliminate the electron emitting material on the lift-off layer;

wherein the lift-off layer is formed by a wet chemical deposition method.

2. The process according to claim 1, wherein the wet chemical deposition method is an electorlytic deposition.

3. The process according to claim 2, wherein said eliminating of the lift-off layer is by electrolysis.

4. The process according to any one of claims 2, 3 and 1, wherein the lift-off layer comprises a metal selected from the group consisting of Cr, Fe, Ni, Co, Cd, Cu, Au, Ag and alloys thereof.

5. The process according to claim 4, wherein the lift-off layer is made from an alloy of iron and nickel.

6. The process of claim 1, wherein the lift-off layer comprises iron and nickel.

7. The process of claim 1, wherein said eliminating of the lift-off layer is carried out for 30–60 min.

8. The process of claim 1, wherein said electrically insulating substrate comprises silica, and said at least one cathode conductor comprises niobium.

* * * * *